US009321151B2

(12) United States Patent
Yan

(10) Patent No.: US 9,321,151 B2
(45) Date of Patent: Apr. 26, 2016

(54) APPARATUS AND METHOD FOR MECHANICAL VICE

(71) Applicant: Guojue Yan, Carpentersville, IL (US)

(72) Inventor: Guojue Yan, Carpentersville, IL (US)

( * ) Notice: Subject to any disclaimer, the term of this patent is extended or adjusted under 35 U.S.C. 154(b) by 203 days.

(21) Appl. No.: 14/142,688

(22) Filed: Dec. 27, 2013

(65) Prior Publication Data

US 2015/0183093 A1 Jul. 2, 2015

(51) Int. Cl.
*B25B 1/12* (2006.01)
*B25B 1/02* (2006.01)

(52) U.S. Cl.
CPC .. *B25B 1/02* (2013.01); *B25B 1/125* (2013.01)

(58) Field of Classification Search
CPC ..... B25B 1/00; B25B 1/02; B25B 1/06; B25B 1/10; B25B 1/12; B25B 1/125; B25B 5/00; B25B 5/02; B25B 5/10
See application file for complete search history.

(56) References Cited

U.S. PATENT DOCUMENTS 1,391,913 A * 9/1921 Smith ..... B25B 1/125 269/177
1,753,924 A * 4/1930 Gordon ..... B25B 1/125 269/157
2,359,951 A * 10/1944 Warman ..... B25B 1/125 269/193
2,471,444 A * 5/1949 Nelson ..... B25B 1/125 269/192
3,007,358 A * 11/1961 Vogl ..... B25B 1/125 269/189
3,193,277 A * 7/1965 Nagamori ..... B25B 1/125 269/181
4,898,371 A 2/1990 Mills et al.
7,036,807 B1 5/2006 Gasparyan et al.
8,534,655 B2 9/2013 Hovarter
2002/0096812 A1 7/2002 Reed
2004/0070132 A1* 4/2004 Varzino ..... B25B 1/22 269/246

OTHER PUBLICATIONS

Author unknown, Woodworking Vise Type 52—With Quick Release Mechanism, website page, Oct. 14, 2013, 3 pages, http://www.fine-tolls.com/G307779.htm.
Author unknown, Quick-Release Front Vises, Lee Valley & Veritas website page, Oct. 14, 2013, 1 page, http://www.leevalley.com/US/wood/page.aspx?p=54873&.
Author unknown, Veritas Quick-Release Front Vise, Lee Valley & Veritas website page, Oct. 14, 2013, 2 pages, http://www.leevalley.com/US/wood/page.aspx?cat=1,41659&p=67755.

* cited by examiner

*Primary Examiner* — Lee D Wilson
*Assistant Examiner* — Tyrone V Hall, Jr.
(74) *Attorney, Agent, or Firm* — Wolff Law Offices, PLLC; Kevin Alan Wolff

(57) ABSTRACT

The present invention pertains to an apparatus and method for holding an item to be worked on in, for example, a mechanical shop, garage or manufacturing facility. More particularly, the present invention relates to the field of mechanical vises that may be used to hold an item firm so that it may be worked on and may be for quick action holding and releasing that may be disabled. The present invention is directed generally to an apparatus and method for improved operation of a vise. The present invention may include a quick action mechanism that allows a vise jaws to be opened or closed quickly so that an operator can be more efficient or productive. The quick action mechanism may include a vise main nut and main nut holder. The vise may also include a lock for the quick action mechanism which may lock the vise main nut.

20 Claims, 10 Drawing Sheets

500A

500B

500C

600A

600B

APPARATUS AND METHOD FOR MECHANICAL VICE

FIELD OF THE INVENTION

The present invention pertains to an apparatus and method for holding an item to be worked on in, for example, a mechanical shop, garage or manufacturing facility. More particularly, the present invention relates to the field of mechanical vises that may be used to hold an item firm so that it may be worked on and may be for quick action holding and releasing.

BACKGROUND

In the areas of product or part manufacturing, machining, and/or repair, there are many times that a part or product must be held firmly to be worked on. One method of doing so includes the use of what is commonly known as a vise. Vise(s) are typically used in order to temporarily hold one or more objects so that work can be performed on the one or more objects. There are a number of different types or species of vise(s). For example, traditional table top mounted vises, such as a mechanics vise, have existed for years. A typical vise is composed of a stationary jaw with a base that can be mounted to a surface. There is a moveable jaw and a guide bar(s) that allows the moveable jaw to move smoothly toward and away from the stationary jaw. Each jaw has a clamping surface for holding a work piece. Further, the vise has a screw threaded bar (referred to herein as the screw or spindle) and lever system which operates the moveable jaw. The screw or spindle typically has a relatively fine pitched thread which provides a large mechanical advantage such that a relatively small amount of torque applied to the lever produces a large clamping force between the jaws. The screw or spindle moves the moveable jaw whereby the fine pitch required for the large mechanical advantage causes the jaw to move a very small distance with each turn. Thus, adjusting the jaws to different opening sizes for clamping of relatively thin and subsequently relatively thick items (or vise versa) requires numerous turns of the lever attached to the screw or spindle.

There are many types of vises used for varying applications. For example, the typical mechanics vise or industrial vise is made of a heavy metal construction and is typically firmly mounted to, for example, a table or bench top so as to be stationary in at least height and location, although some conventional vises may be able to rotate at their base or base plate in a circular motion. A conventional mechanics bench vise typically has the following major parts: a movable jaw, a stationary jaw, a screw or spindle, a vise main nut, and a base plate. The moveable jaw may be, for example, a square or round sliding bar. It is usually made from gray or ductile iron and may include a steel jaw insert. The stationary jaw may mounted to or be integrally formed with a base plate and securely mounted to a table or bench. The stationary jaw may include a square or round opening to allow moveable jaw's square or round sliding bar to move in and out of it. It is usually made from gray or ductile iron and may also include a steel jaw insert.

The movement of the movable jaw is generally effected by rotating a tommy bar attached to the main screw or spindle which, in turn, rotates the screw or spindle. This causes the screw or spindle to advance through the fixed jaw by virtue of the co-operating screw-threads therein which means that the moveable jaw (which is axially fixed to the screw or spindle) advances toward or away from the fixed jaw (depending upon the direction of rotating the tommy bar) a small amount at a time based on the spacing of the screw threads.

When it is desired to clamp an object in the vise's jaws, the user must hold the object in the space between the jaws whilst turning the tommy bar in order to advance the moveable jaw toward the fixed jaw (and the object held in between). When the moveable jaw reaches the object and holds it against the fixed jaw, clamping is effected. It can be rather slow to advance the moveable jaw to clamp the object effectively, especially if the jaws are wide apart initially. Indeed, when the jaws are wide open but it is desired to clamp a small object, it is time-consuming to wind the screw until the jaws approach the object. Furthermore, when it is desired to release the object from the jaws, depending on the size and shape of the object, the tommy bar may have to be turned for an inconveniently long time in order to move the moveable jaw sufficiently away from the fixed jaw in order to release the object.

Recent developments in vises have allowed for a quicker adjustment of the vise. The vise designs have generated solutions that allow the fine pitched thread mechanism to be disengaged while allowing rough adjustments of the vise head. For example, the "slowly adjustable" problem may be alleviated by a known type of vise which incorporates a "quick-release" mechanism. Instead of the screw-threaded main vise screw permanently engaging with a screw-thread on the interior of the fixed jaw, the fixed jaw screw-thread comprises a half screw-threaded main nut which is, normally, urged into engagement with the main vise screw, for example by means of a spring. When it is desired to actuate the "quick-release" mechanism, a lever pushes the main nut away from the main vise screw by overcoming the force of the spring. In this way the main vise screw is released from engagement with the main nut, allowing the main vise screw to be moved axially free of the fixed jaw. The lever is actuated, on demand, by the vise operator which can be inconvenient since he may already need his hands to operate the tommy bar and/or support the object which is about to be released from or indeed clamped in, the vise.

Furthermore, where the traditional vise had a female thread integral to the stationary jaw that engaged with the screw, some new vises may have a female thread part separate from the stationary jaw. The separate part is called a semi-thread because it engages with less than 180.degree of the screw. The semi-thread rides in a track system in the stationary head such that a mechanism can disengage the semi-thread from the screw as desired. With the semi-thread disengaged, a user can slide the moveable jaw to the approximate opening size required for application at hand. A separate lever on the moveable jaw turns a bar or shaft that subsequently disengages the semi-thread from the male thread. The semi-thread is typically spring loaded into engagement with the male thread. With the semi-thread disengaged the jaw opening can be adjusted to the desired size. This system is a vast improvement over previous vises, increasing the efficiency of use.

However, the new quicker action vises are not without problems, because they typically have merely a spring which presses the main nut into engagement with the threaded screw, the threads must be somewhat radial to reduce the tendency for the threads to have a radially outward component of reaction, causing the half threaded main nut potentially to spring off the vise screw, when the tommy bar is very tightly clamped. Radial screw-threads are expensive to produce and cannot satisfactorily be roll-formed. Further, these new type of vises typically require two levers to operate. One lever is required to turn the bar and subsequently disengage the semi-thread. While holding this lever in position to keep the semi-thread out of engagement, the jaw opening can be adjusted to the appropriate size by pulling or pushing on the moveable jaw. To apply large clamping force the user must let go of this first lever and grab the second lever that turns the screw to apply a significant clamping force. On the other hand, some quick action vises do not allow the semi-thread main nut to be engaged rather than disengage when the tommy bar is turned in the untightening direction so that the vise movable jaw may be slowly backed away from a work piece.

Therefore, a need exists for an improved apparatus and method of vise clamping that would allow a user to quickly adjust the opening size of the jaws and apply clamping force to the jaw through the use of one lever, while having a means for selectively holding the main nut engaged while loosening the vise jaws a small amount at a time. It is therefore an object of the present invention to provide an improved mechanism for rapidly adjusting the relative position of the jaws of a vise as a primary action while having a slow adjustment of the vise jaws as a secondary action, which alleviates the above-described problems.

SUMMARY

The present invention is directed generally to an apparatus and method for holding an item to be worked on or a work piece, for example, a type of mechanical vise or bench vise for holding firm an item to be worked on in a manufacturing facility, a repair shop, a garage, or a personal work shop. This invention is in the field of bench vise(s) including an improved mechanism for rapidly adjusting the relative position of its jaws and/or ensuring selective rapid position adjustment such that rapidly adjusting the relative jaws' positions only occurs when desired by a user.

The present invention generally includes a stationary jaw with a first clamping surface and a moveable jaw with a second clamping surface connected and operated by a threaded shaft, main vise screw, or spindle. The spindle may be fixedly attached to the movable jaw and move the moveable jaw toward and away from the stationary jaw, i.e., enable the jaws to move toward each other when the main vise screw or spindle is rotated in one direction through a main vise nut. The main vise nut may be attached to the stationary or fixed vise jaw with a main vise nut holder. The main vise nut holder may be attached to the stationary or fixed vise jaw with a bolt or screw, or any other method or means to make it firmly attached to and/or part of the stationary jaw. There may be a main nut locking mechanism that is attached to the stationary jaw. The main vise screw or spindle may disengage the movable jaw away from the stationary jaw when rotated in the opposite direction with the main nut locking mechanism in a locking position allowing either minor adjustment, or with the main nut locking mechanism in an unlocked position allowing for rapid adjustment or translation of the vise jaws relative to one another, depending on the position of the main vise nut and the main nut locking mechanism.

According to one aspect of the invention, a clamping apparatus includes a fixed jaw having a first clamping surface, a moveable jaw having a second clamping surface, and a spindle attached to both the fixed jaw and the moveable jaw for providing movement of the moveable jaw relative to the fixed jaw. The spindle may be rotatable in a first direction to move the moveable jaw toward the fixed jaw and may be rotatable in a second, e.g., opposite, direction to disengage the fixed jaw from the spindle allowing rough adjustment of the moveable jaw. A handle or lever may operate the spindle. According to another aspect of the invention, a clamping apparatus includes a base for attaching the apparatus to a surface, a fixed jaw having a first clamping surface, a moveable jaw having a second clamping surface, a spindle attached to the moveable jaw, the spindle having a locking mechanism which may lock the main vise nut or semi-nut which engages a threaded portion of the spindle, wherein the main vise nut or semi-nut may be fixedly attached to the fixed jaw with a main nut holder that limits rotation of the main nut relative to the fixed jaw. One handle or lever may operate the spindle and one lever or bolt may lock the main vise nut or semi-nut and keep it from rotating to a position that would disengage the spindle from the main vise nut.

According to another aspect of the invention, a method for clamping a work piece may be performed in at least the following way and may include rotating a spindle in a first direction, the spindle coupled to a moveable jaw and a fixed jaw, wherein rotation in the first direction may cause the moveable jaw to move toward the fixed jaw thereby clamping a work piece between the moveable jaw and the fixed jaw. Next, rotating the spindle in a second direction, e.g., an opposite direction, may disengage the spindle from the fixed jaw. Then, making large or small distance adjustment of the moveable jaw to set it at a desired location while the spindle is disengaged from the fixed jaw and, if desired, to remove the work piece. Finally, rotating the spindle again in the first direction may be used to reengage the spindle with the fixed jaw so as to close the jaws or to grab another work piece in the jaws of the vise.

According to a further aspect of the invention there is provided a vise comprising a moveable jaw mounted on a screw-threaded main vise screw which is axially fixed with respect to said moveable jaw but is rotatable within it, a fixed jaw mounted on the main vise screw, the jaws being moveable toward or away from one another upon rotation of the main vise screw, and a quick release mechanism including an at least partially screw-threaded element moveable between an engaged position in which the screw-threaded element engages the screw-thread of the main vise screw and a disengaged position in which the partially screw-threaded element is disengaged from the main vise screw enabling the main vise screw to be moved freely axially quickly with respect to the fixed jaw, in which the mechanism, when it is in said engaged position, is axially shiftable between axial limits in the fixed jaw by rotation of the main vise screw, said limits defining a first locked position, wherein said mechanism is prevented from moving to said disengaged position, and an unlocked position in said mechanism can move to said unlocked position.

According to a still further aspect of the invention, a half-threaded main vise nut may be made by, for example, drilling a first hole laterally or axially through the side of the main vise nut at a first generally center location. Next the first hole may be threaded. Then a second lateral or axial hole may be drilled through the main vise nut at a different location slightly offset from the first hole location so that a portion of the threads are thereby removed and forming a slot, channel or threadless area in the vise main nut that will allow a threaded bolt or spindle to movably slide through without catching on the remaining threads in the vise main nut or half-nut. In one variation the vise main nut may be a sleeve which is chamfered or beveled on one or more sides, and/or may have one or more ridges formed to stop rotation of the vise main nut around it center in one or more directions. The relation between the vise main nut and the vise main nut holder is designed in a way such that the more a user turns the handle, lever, or spindle to tighten the vise jaws, e.g., clockwise, the tighter the engagement of the threads (more threads engagement force) that results in more clamping force one can apply to the vise jaws. In other words, the amount of thread engagement force may vary, i.e., variable thread engagement forces, with the clockwise rotation or movement of the vise handle, lever, or spindle. This is different from some other vises, including some other quick action vises, that have threads engagement force that is constant regardless of the amount of turning the spindle to tighten the jaws (e.g., turning clockwise for tightening) and which may create a chance that vise jaw to fail to hold the parts all a sudden, and the more one turns the handle or lever counter-clockwise, the more the spindle will be against the smooth side of the main nut so that the easier the quick action realized. Furthermore, the vise main nut holder may be formed from, for example, cast iron using a casting or molding process. The vise main nut and/or the vise main nut holder may also be made from, for example, cast iron and/or steel or other materials by, for example, casting, molding, and/or machining.

Still further aspects included for various embodiments will be apparent to one skilled in the art based on the study of the following disclosure and the accompanying drawings thereto.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

Figure 1:
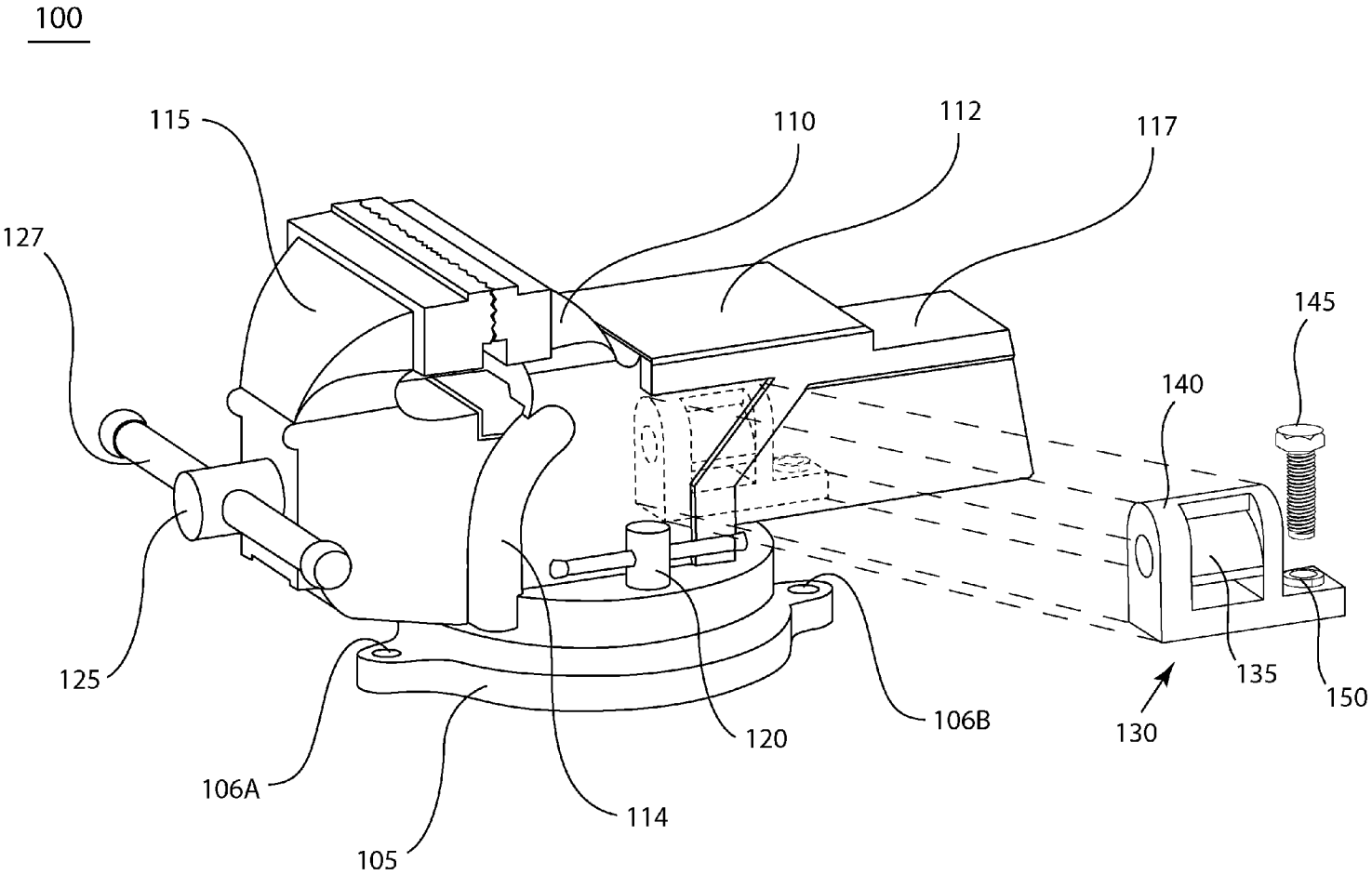
FIG. 1 is a perspective view of the present vise invention looking at it from the top right side with the vise main nut and nut holder assembly with mounting bolt shown extracted from the vise and displayed separately to the right of the vise, according to at least one exemplary embodiment of the invention.

A bench vise or mechanics vise is one way that people hold onto or hold fast a work piece, object, or part so that work may be done on it. For example, a worker may wish to hold a work piece, object, or part tight on a vise between vise jaws and, for example, drill a hole on, in, or through the part.

As noted above, a bench vise or mechanics vise is often used for firmly clamp an object while a person or a machine is doing some work on the object. While a person is turning the spindle handle (clockwise or counter-clockwise), the spindle is moving in or out of the vise main nut via thread engagement so that the moveable jaw is moving in or out of the stationary jaw then vise jaws can open or close. For every revolution the spindle turns, the vise opens or closes one thread. For example, if the spindle has 8 threads per inch, one revolution of the spindle will open or close the vise jaws ⅛ of an inch. While using a conventional vise, a person will need to open the vise jaws by turning handle counter-clockwise one revolution at a time until vise opens to the width wider than the object. Then he can turn handle clockwise until the vise jaws hold the object firmly. To take the object out of a conventional vise, a person can turn the handle counter-clockwise one revolution at a time until the object is loose. The disadvantage of the conventional vise is that a person has to turn the handle one revolution at a time so the vise will open or close one threads at a time no matter if the vise is holding an object or not. It is very slow and not very productive.

A mechanics bench vise typically has the following major parts: a movable jaw, a stationary jaw, a spindle or threaded main screw, a vise main nut, and a base plate. The moveable jaw may be, for example, a square or round sliding bar. It is usually made from gray or ductile iron and may include, for example, a steel jaw insert. The stationary jaw may mounted to or be integrally formed with a base plate and securely mounted to a table or bench. The stationary jaw may include a square or round opening to allow moveable jaw's square or round sliding bar to move in and out of the stationary jaw. It may be made from, for example, gray or ductile iron and/or steel, and may also include a steel jaw insert. The spindle or threaded main screw may have a cross handle on a head at one end and be threaded through the vise main nut. The spindle or main screw may have full male threads on the main body. The spindle or main screw may be attached to moveable jaw so that it may spin freely therein, and may be made from steel. The spindle may couple the moveable jaw to stationary jaw via the vise main nut. Since the spindle has male threads on it while a vise main nut has female threads on it, the spindle may engage vise main nut so that the moveable jaw can move in or out of the stationary jaw. The vise main nut often may have a full female threaded hole through it, and may be firmly attached thereby to the stationary jaw of a vise. It may be made from ductile iron or steel. The base plate is optional for allowing vise fixed and moveable jaw configuration to rotate and locked at different positions relative to where the vise is mounted (on a table top, work bench top, truck bed, etc.). The base plate may be made from gray or ductile iron. The moveable jaw may include an elongated bar that engages the stationary jaw via the sliding bar. With this kind of vise the movable jaw can only move one thread at a time in either direction relative to the stationary or fixed jaw, for each turn an operator turns the handle, lever, or spindle.

On the other hand, the recent advent of the quick action type of vise and the present invention allow a user to disengage the movable jaw from the fixed jaw by disengaging the limited travel spindle threads from the main nut, so that the relatively movement of the jaws to one another may be much quicker. In the case of the quick action type vise, a user can slide the movable jaw toward or away from the fixed jaw quickly and easily, so as to reduce the number of times a user has to spin the spindle to grip or release a work piece from the jaws of the vise.

According to the present invention, the quick action vise may be similar to and have many of the parts that a conventional vise has with, for example, one or more of the following differences. The vise main nut may have, for example, slot shaped hole instead of round shaped hole through which the threaded main spindle extends and engages. Further, the slot shaped hole may have, for example, approximately half or one side of the inner circumference of the hole being threaded while the other portion is smooth without threads, instead of a full threaded hole, thus being referred to herein as a vise main half nut. In at least one embodiment, the vise main half nut is not attached directly on the fixed or stationary jaw, but may be held by or within a nut holder. The nut holder may be, for example, bolted, welded to, or attached to, with any other means, the fixed or stationary jaw, or may be made to be part of the fixed or stationary jaw. The nut holder may limit the vise main half nut to a small amount or distance of lateral movement in the direction of the axial length of the vise spindle shaft while allowing the main half nut to rotate a limited amount inside the nut holder based on the shape and size of the main half nut versus the height of an opening in the main nut holder. The outer surface of the vise main half nut may be, for example, eccentric in shape and have a maximum width or height so as to engage and stop on one or more surfaces of the nut holder when engaged with the shaft of the spindle and rotated in a clockwise and/or counter clockwise direction as the spindle is turned either clockwise or counter clockwise. For example, the vise main half nut may, for example, rotate inside the nut holder 180 degrees so as to enable the vise main half nut to either engage or disengage the vise main half nut threads with the threads on the spindle. The main nut holder may be of a width size and height such that it fits inside the movable jaw sliding bar and the sliding bar can move freely back and forth without interference from the main nut holder.

While the threads of the spindle and the main half nut are engaged the quick action vise may act as the same as a conventional vise, i.e., the moveable jaw moves one threads at a time while turning the spindle. When the vise main half nut is rotated around the spindle threaded shaft by, for example, 180 degrees, and the threads of the vise main half nut are not engaged, the quick action vise spindle and movable jaw can be slid in and out the stationary or fixed jaw quickly by holding the spindle handle and pushing or pulling so that vise jaws can open or close much more quickly (having only friction of the vise parts interaction limiting its motion) than when the vise main half nut threads are engaged with the spindle threads.

The half-threaded main vise nut may be made by, for example, drilling a first hole laterally or axially through the side of the main vise nut at a first generally center location. Next the first hole may be threaded. Then a second lateral or axial hole may be drilled through the main vise nut at a different location slightly offset from the first hole location so that a portion of the threads are thereby removed and forming a slot, channel or thread-less area in the vise main nut that will allow a threaded bolt or spindle to movably slide through without catching on the remaining threads in the vise main nut or half-nut. In one variation the vise main nut may be a sleeve which is chamfered or beveled on one or more sides, and/or may have one or more ridges formed to stop rotation of the vise main nut around it center in one or more directions. The relation between the vise main nut and the vise main nut holder is designed in a way such that the more a user turns the handle, lever, or spindle to tighten the vise jaws, e.g., clockwise, the tighter the engagement of the threads (more threads engagement force) that results in more clamping force one can apply to the vise jaws. In other words, the amount of thread engagement force may vary, i.e., variable thread engagement forces, with the clockwise rotation or movement of the vise handle, lever, or spindle. This is different from some other vises, including some other quick action vises, that have threads engagement force that is constant regardless of the amount of turning the spindle to tighten the jaws (e.g., turning clockwise for tightening) and which may create a chance that vise jaw to fail to hold the parts all a sudden, and the more one turns the handle or lever counter-clockwise, the more the spindle will be against the smooth side of the main nut so that the easier the quick action realized. Furthermore, the vise main nut holder may be formed from, for example, cast iron using a casting or molding process. The vise main nut and/or the vise main nut holder may also be made from, for example, cast iron and/or steel or other materials by, for example, casting, molding, and/or machining.

In at least one embodiment, a user may activate the quick action feature of the vise by turning the handle or spindle counter-clockwise. In at least one embodiment, a user may also disable the quick action by turning the handle or spindle clockwise. With this type of function, a quick action vise according to the present invention using the quick action feature may have the advantage to slide open or close quickly, for example while it is not holding an object. While the vise is closed by the user pushing the jaws toward one another to hold a work object between its jaws, the user may then turn the handle clockwise to disable the quick action and engage the threads on the spindle with the partial threads of, for example, a vise main half nut, so that jaws will slowly contract toward one another and thereby clamp the work object firmly with the jaws of the vise. Using the quick action vise according to at least one embodiment of the present invention, a user or person can open or close the vise jaws quickly, almost instantly, while the quick action feature/function is enabled, regardless of the location of the movable jaw relative to the fixed jaw. When the quick action feature is enabled, the user or person can turn the handle and/or spindle clockwise to disable the quick action feature/function and re-engage the spindle threads to the vise main nut half threads, for example, when he wants to hold the work object firmly between the movable and fixed jaws. So, in using the quick action feature/function in this way, a user or person will not waste valuable time when opening or closing the vise jaws. In this way the quick action feature/function may make the vise user quicker at performing a desired task with the vise and thus more productive. However, in other embodiments of the present invention, the vise may include a vise main nut locking mechanism so that the vise main half nut threads may stay engaged with the threads of the spindle at all times, whether the spindle is turned clockwise or counterclockwise, thereby disabling the quick action feature/function. This may be particularly useful to ensure safety in case the spindle handle is accidentally turned counter clockwise when not intending to remove the work piece from the jaws of the vise or when the user is hitting or jarring the work piece. This feature/function and the hardware to achieve it will be discussed more below.

In various embodiments of the present invention, the particular design of the quick action feature/function is primarily in the design, operation and manufacture of the vise main half nut and nut holder. With respect to the design and operation of the quick action, the quick action or quick release feature/function is provided with relatively few parts that are designed to fit within a small cavity of a movable jaw slide bar and operational simply by turning the spindle counter clockwise to enable and counter-clockwise to disable. The main half nut may include a friction type device, such as a pin or rivet shaped device that may extend inward from an outside surface to an inner surface of the main half-nut and a spring attached to both the main half nut and the pin, that together apply force to the shaft of the spindle relative to the main half nut so that the friction between the pin and the shaft of the spindle will spin the main half nut within the nut holder until it catches on one side or the other. The pin (or rivet) and spring may thereby provide force so that the spindle is either engage completely or disengage completely. In this way, they prevent the spindle from partial engagement. Partial engagement may be very dangerous to a user or others in the vicinity of the vise while it is being used, i.e., the jaws of the vise may accidentally open and a work item may be unexpectedly released causing injury to the user or others near the vise. Preferably, the quick release mechanism comprises this friction device disposed on the main vise screw which urges the screw-threaded element into engagement with the main vise half screw or spindle and ensures that the screw threads on the spindle engage the main half nut, for example, when the main vise screw or spindle is rotated in a direction that brings the vise jaws towards one another (e.g. for right handed threads this is when the spindle is turned in the clockwise direction and for a left hand threaded spindle this may be when the spindle is turned in the counter clockwise direction). For example, when turning the spindle clockwise, the main nut will be rotated too with the spindle clockwise by friction. Since the main nut is eccentric, it will stop rotation by contacting or abutting a portion of the nut holder, for example an upper beam and/or the lower base of the nut holder before the rotation reaches, for example, approximately 180°.

While continuously turning the spindle to 180° or more counterclockwise, the spindle threads against the friction pin may rotate or push the main half nut in the counterclockwise position approximately 180° to the smooth side of the main half nut to disengage the threads fully. The quick action may in this way then be enabled. By turning the spindle counter-clockwise, the main nut may also be rotated counter-clockwise with the spindle until it is stopped by nut holder before the rotation reaches a predetermined amount, for example, approximately 180°. To switch back to a disabled quick action state, a user may continuously turn the spindle clockwise by a predetermined amount, for example approximately 180°, so that the spindle will push or rotate the vise main half nut to move to the threaded side to thereby engage the threads of the spindle shaft fully to the half threads on the main half nut. The quick action may then be disabled at this point so that the vise jaws may only be moved slowly toward one another to hold (or release if tightened) the work object between them firmly, i.e., to operate in this state similar to how a vise with a main nut that has a full set of threads and is fixedly attached to the fixed jaw so that it does not rotate or turn around its center or axis. Although there are known other quick action bench or mechanics vises, there are a number of major feature/functional advantages of the present invention vise compared to other quick action vises. On some of the other quick action vises, there is a switch to activate the quick action. While using those vises, a user or person needs to push the switch (to activate quick action) with one hand and to open and close the vise jaws with the other hand, so that they have no hand to hold the object that is to be placed between or removed from the vise jaws. As such, the user or person will risk to injury himself and/or damage the object if the object falls. According to at least one embodiment of the present invention quick action vise, a user or person can turn the handle with one hand to activate the quick action feature/function and quickly open/close the vise at the same time, while he can hold the object between vise jaws with the other hand so that the object will not fall.

In various embodiments of the present invention, the vise may also include a quick release disable mechanism or safety mechanism, for example a screw, a bolt, a toggle pin, that may be used to disable or deactivate the quick release or quick action feature/function by keeping the vise main half nut from rotating within the nut holder and maintaining the engagement of the spindle threads and the main half nut threads. In these embodiments the nut holder may have at least one open side so that an outer surface of the main half nut may be contacted by one end of, for example, a screw, a bolt, or a toggle pin that is used for the quick release disable mechanism. The disable or safety mechanism may be attached to the fixed jaw portion of the vise using, for example, a threaded through hole. An elongated portion of the disable or safety mechanism may extend through a portion of the movable jaw slide rail, which may be for example an elongated slot formed along the main axis of the movable jaw slide rail. The disable or safety mechanism may extend through an open side of the nut holder, and abut or connect to one side of the vise main half nut, so as to stop the vise main half nut from rotating or turning when the spindle is turned in the direction that would normally enable the quick action or quick release feature/function, e.g., when the spindle is turned counter clockwise. As such, the quick action or quick release disable or safety mechanism may be moved by a user or person inward from the main body of the vise to abut at least one point on the outer surface of the vise main half nut so as to disable the quick action or quick release feature/function. Alternatively, the quick action or quick release disable or safety mechanism may be moved by a user or person outward from the main body of the vise so as to not abut the at least one point on the outer surface of the vise main half nut, so as to allow the main vide half nut to rotate about its axis in response to turning the spindle and thereby enable the quick action or quick release feature/function. In various embodiments of the present invention, a user of the vise would most often have the quick release disable mechanism or safety mechanism in an outward position so that the user or person can easily operate the vise using the quick action or quick release feature/function. An even more detailed description of the invention will now be provided with particular reference to the figures provided herewith.

Referring now to FIG. 1, a perspective view of at least one exemplary embodiment of the present vise invention 100 is provided, looking at it from the top right side with the vise main nut and nut holder assembly with mounting bolt shown extracted from the vise and displayed separately to the right of the vise so as to highlight at least one or more of the unique aspects of the present invention. The vise according to at least one embodiment of the present invention 100 may have a vise main portion that may include a base plate 105 that may be mounted on, for example, a work bench with bolts via bolt through holes 106A and 106B, and upon which the rest of the vise may be mounted. The base plate may be circular to enable the vise to rotate upon it to the left or right. The vise may also include a fixed or stationary jaw portion 110. The fixed or stationary jaw 110 may include a flat plateau area 112 for setting and striking a work piece on with a hammer so as to bend a work piece. The fixed jaw 110 may also have a strengthening rib or ridge 114 that keeps the fixed jaw 110 from cracking or breaking under pressure when a work piece is held in the vise. The vise may have a movable jaw 115 that moves toward and away from the fixed jaw 110, and may include a slide bar 117 that slides in and out of a cavity in the middle or center part of the fixed jaw 115. The slide bar 117 may be an elongated hallow bar, and may have three sides, for example a top bar and two side bars. The vise main portion may be designed to turn or pivot on the base plate 105 and may then include a locking and unlocking screw or spindle 120 (with or without a tommy bar) that may be turned or tightened by a user to either hold the fixed jaw portion 110 along with the moveable jaw portion 115 in a set position relative to the base plate 105, or be untightened or unscrewed to by a user so that the user can rotate or turn the jaws to a different position relative to the table of bench upon which the vise is attached.

The vise may include a vise main spindle 125 fixedly attached to the moveable jaw 115. The spindle 125 may have a tommy bar or handle 127 perpendicular to it and connected thereto through one end, for example a head end, of the spindle. The spindle may also include a threaded shaft (not shown in this figure) that extends inside and along the length of the slide bar 117 of the moveable jaw 115. The threaded shaft of the spindle 125 may extend through a subassembly 130 that includes a vise main nut holder 140 and vise main nut, which may be a vise main half nut 135 (shown in this figure as dotted lines on the inside of the stationary or fixed jaw 110 housing and the moveable jaw 115 slide bar 117, and as solid lines in the cut-away or exploded view portion). The outside surface shape of the vise main half nut may be eccentric or oblong so as to have one longer side and one shorter side, and may have a through hole that is not perfectly circular in shape, such as a slot shaped or oval shaped through hole into which threaded spindle 125 shaft may extend. The vise main half nut may have threads on half of the through hole and is smooth on half of the through hole along its lateral length. The subassembly 130 may be fixedly attached to the fixed jaw 110 housing by using a bolt 145 through a hole 150 in the vise main nut holder 140 (e.g., the bolt 145 may be screwed into a threaded hole in the fixed jaw 110 housing (not shown). A washer 150 may be included on the bolt 145. The movement of the movable jaw 115 may be activated by the vise main spindle 125 to move the movable jaw 115 toward or away from the fixed jaw 110 by spinning it on its center axis using, for example, a tommy bar 127. The spindle 127 may include threads, and the threads may be right handed threads or left handed threads. The vise main spindle 125 threaded shaft may extend through and interface with at least partial threads within the vise main half nut 135, so as to enable the moveable jaw 115 to slowly move toward or away from the fixed jaw 110.

Figure 2:
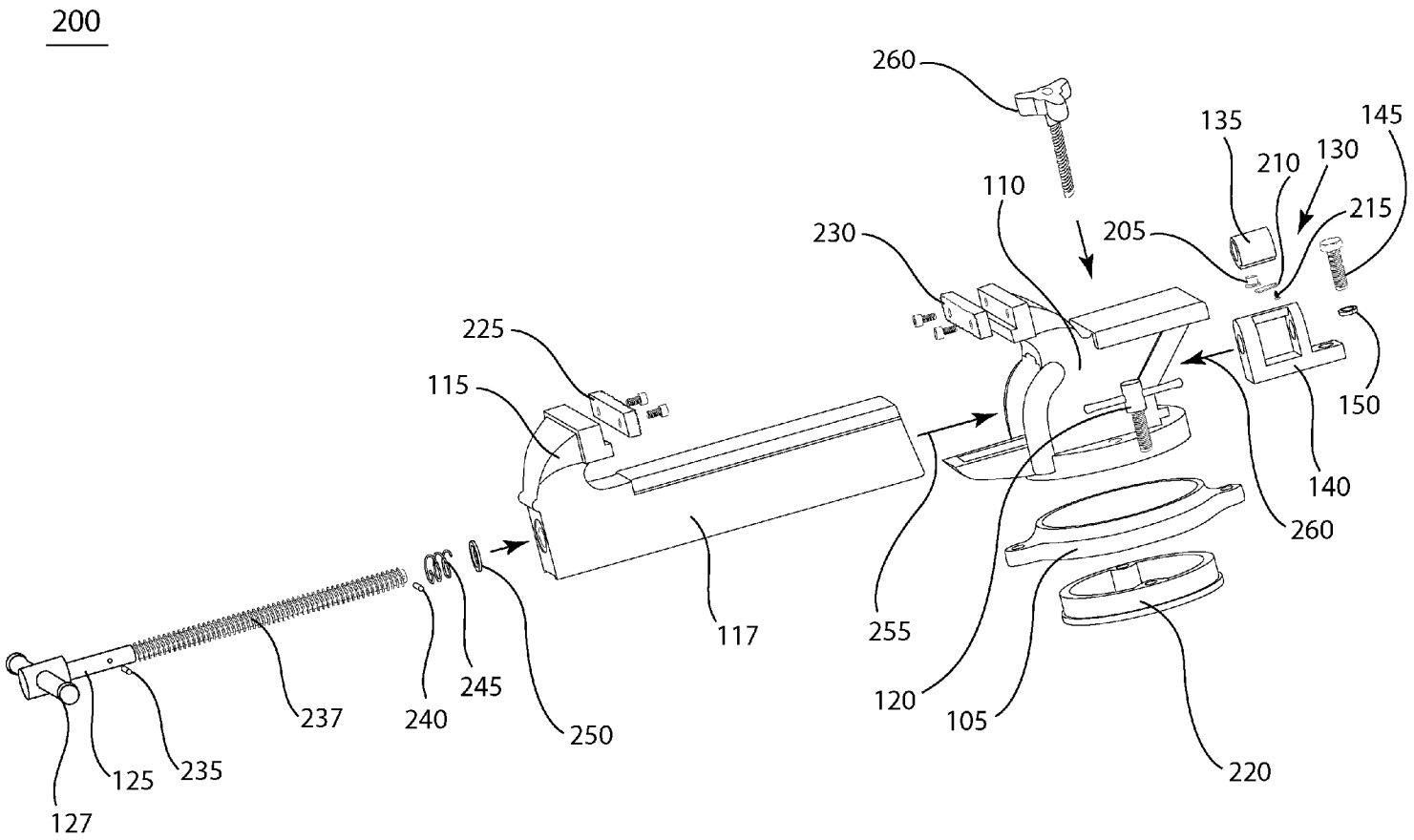
FIG. 2 is an exploded perspective view of the present invention looking at it from the top right side with the parts all separated but in their relative positions to one another when the vise is assembled, according to at least one exemplary embodiment of the invention.

Referring now to FIG. 2, an exploded perspective view 200 of the present invention is provided looking at it from the top right side with the parts all separated but in their relative positions to one another when the vise is assembled, according to an exemplary embodiment of the invention. As can now be more clearly seen, a swivel ring 220 may be placed inside of the base plate 105, and may contain threaded holes into which the threaded end of one or more locking spindle(s) 120 may be screwed, so as to hold the stationary jaw 110 housing on top of the base plate 105 in a manner that enables it to pivot or turn about a center axis unless the locking screw(s) 120 (which may or may not include a tommy bar or handle as shown) is screwed into the swivel ring 220 urging the stationary or fixed jaw 110 housing to the base plate 105 (that may be fixedly mounted to, for example, a table or a bench). The swivel ring 220, the base 105, and the stationary jaw 110 may be made of a metal material, for example gray iron, ductile iron, steel, etc., and may be formed by casting, molding, and/or machining. The stationary or fixed jaw 110 may have an opening 255 for receiving the movable jaw 117 and a jaw insert 230 attached to its upper jaw face via bolts to ensure a desired interface surface to interface a work face with a work object or the opposite work face of the moveable jaw, and may be made of a different material such as plastic, rubber, or durable metal such as steel. The movable jaw 115 may have a square, rectangular or round sliding bar 117 that slides into the opening 255 in the housing of the stationary or fixed jaw 110. As shown in this embodiment, the moveable jaw slide bar 117 is made to be rectangular having more height than width. The moveable jaw 110 and its sliding bar 117 may be made of a metal material such as gray iron, ductile iron, steel, etc., and may be formed by casting molding, and/or machining. The moveable jaw 115 may have a jaw insert 225 that may be made of a different material than the moveable jaw body, for example a strong metal material such as steel or a soft pliable material such as plastic or rubber.

The stationary or fixed jaw 110 may be moveably coupled to the moveable jaw 115 of the vise by use of the spindle 125 shaft 237 being inserted into laterally through a hole in the front end wall of the moveable jaw 125 and lateral holes in the nut holder 140 and vise main nut 135, which may be a half nut, which are mounted inside the opening 255 of the stationary or fixed jaw 110 housing as indicated by directional arrow 260 and attached using bolt 145 and washer 150. In one variation, the nut holder 140 may be made into part of stationary or fixed jaw 110 by casting or molding. The spindle 125 shaft 237 may be completely or partially threaded with right hand threads or left hand threads. Once the spindle shaft 235 is inserted into the hole in the front wall of the moveable jaw 115, a spring 245 and washer 250 may be slipped over it and moved to abut the inside of the moveable jaw 115 front wall, and may be held on with, for example, a pin or a clip 235. In this way, the spindle 125 is fixable attached to the moveable jaw 115 in the lateral direction, but may freely rotate so that it may be engaged with the threads inside the vise main nut 135 and move the moveable jaw toward or away from the stationary or fixed jaw 110 based on turning the spindle 125 clockwise or counter-clockwise. The quick action or quick release feature/function may be achieved in part by providing a friction pin 205, a spring 210, and a screw 215 to hold the spring 210 onto a side of the vise main nut 135 and the head of the pin 205, so as to urge the friction pin 205 inward so that its other end rides on and apply pressure to a side of the spindle 125 shaft 237. A disabling mechanism, for example a spindle, screw, bolt or push switch 260, may be inserted through a side of the stationary or fixed jaw 110 housing, that may include a threaded through hole, and extend through a slot in one side of the moveable jaw 115 slide rail 117 (not shown in this figure) so that its internally extending end can abut a side of the vise main nut 135 to stop it from rotating or turning when the screw or bolt 260 is tightened inward. In at least this manner, the quick action or quick release feature/function may be disabled by the spindle, screw, bolt or push switch 260. A more detailed description of the mechanization, manufacture, and operation of the quick action or quick release feature/function and the disabling mechanism follow.

Figure 3:
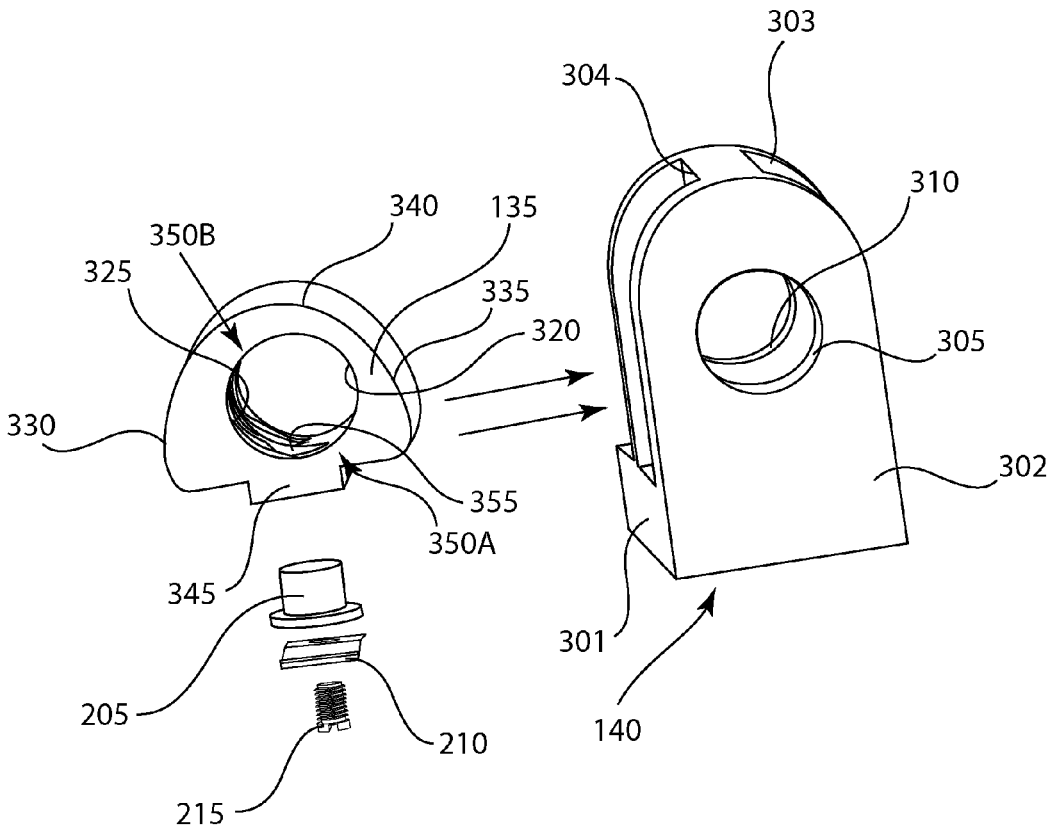
FIG. 3 is a perspective view of the vise main nut, vise main nut holder, friction stud, tension spring and spring attachment screw looking at them from the top left front, according to at least one exemplary embodiment of the invention.

Referring now to FIG. 3, a perspective view 300 is provided of the vise main nut 135, vise main nut holder 140, friction stud or pin 205, tension spring 210 and spring attachment screw 215, looking at them from the top right front, according to an exemplary embodiment of the invention. The vise main nut holder 140 may have a base plate 301, a front wall 302, a back wall 303, and a top bar 304. The front wall 302 and the back wall 303 may be connected to the base plate 301 and spaced apart a distance sufficient to allow the width of the vise main nut 135 to fit between them without allowing much play or friction between the walls 302 and 303 and the relatively flat sides of the vise main nut 135. In at least one embodiment, walls 302 and 303 may be approximately 1⅜ inches apart from each of their inner faces, and the vise main nut may have a width from on flat surface to the other of approximately 1¼ inches. However, one skilled in the art will recognize that the size of the vise main nut holder 140 and its parts may be of any size based primarily on the overall size of the vise, i.e., the larger the vise size, the larger each of the parts of the vise including the vise main nut 135 and the vise main nut holder 140. The bigger the vise, the bigger the vise jaws, the more force the vise can apply.

The front wall 302 and the back wall 303 may act as lateral stops for the vise main nut 135. The front wall 302 and the back wall 303 may be rounded on their ends opposite the base plate 301, and may be a semi-circle in shape. The top bar 304 may connect the top of the front wall 302 and the back wall 303 near their centers to provide for structural integrity and the top bar may act as a stop for the vise main nut 135 so as to keep it from rotating more than approximately 180 degrees. The front wall 302 may have a smooth surface through hole 305 and the back wall 303 may have a smooth surface through hole 310. The base plate 301 may be mounted to an inner floor wall of the stationary or fixed jaw 110 housing.

The vise main nut 135 may be a half nut and be eccentric in shape. For example, the side profile of the vise main nut 135 may be a half heart shape, a human ear shape, a tilted tear drop shape, etc. such that it is oblong or elongated in one direction. As such, the vise main nut 135 may have one height or distance, from sides 330 and 335, that is bigger or longer than the height or distance, from a second set of sides 340 and 345, and have a through hole 320 that is slotted or elongated in shape. The through hole 320 may include threads 325, which may be partial threads. In at least one embodiment, the vise main nut 135 may be a half nut, i.e., it may be approximately half threaded, for example, having threads from point 350A to 350B. The vise main nut 135 may also include a plateau 345 on one side, a generally flat side through which a smooth hole 355 may be formed. The through hole may be located such that it is at one side of the partial threads 350A. This through hole 355 may have the friction pin or post 205 inserted into it so that one end of the friction pin or post 205 ride along the spindle shaft 237 threads when the spindle 125 shaft 237 is inserted through the through hole 320, so that the vise main nut 135 will tend to spin in the same direction the spindle 125 is turned until the vise main nut 135 stops due to the height of the vise main nut 135 being larger than the height of the opening in the vise main nut holder 140. The friction pin or post 205 may be held in place with, for example, a spring or plate 210. And the spring or plate 210 may be attached to the vise main nut 135 via a screw 215 that may be screwed into a small threaded hole (not shown) in the plateau 345 of the vise main nut 135.

Figure 4A:
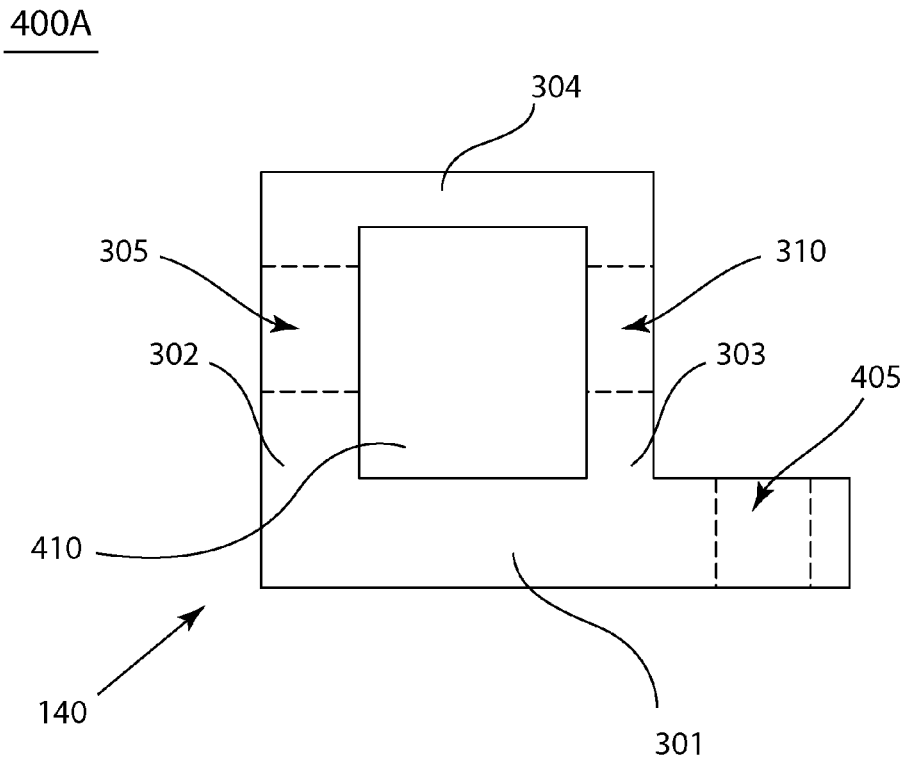
FIGS. 4A and 4B are a side view and a top view, respectively, of the main nut holder for the present invention, according to at least one exemplary embodiment of the invention.
Figure 4B:
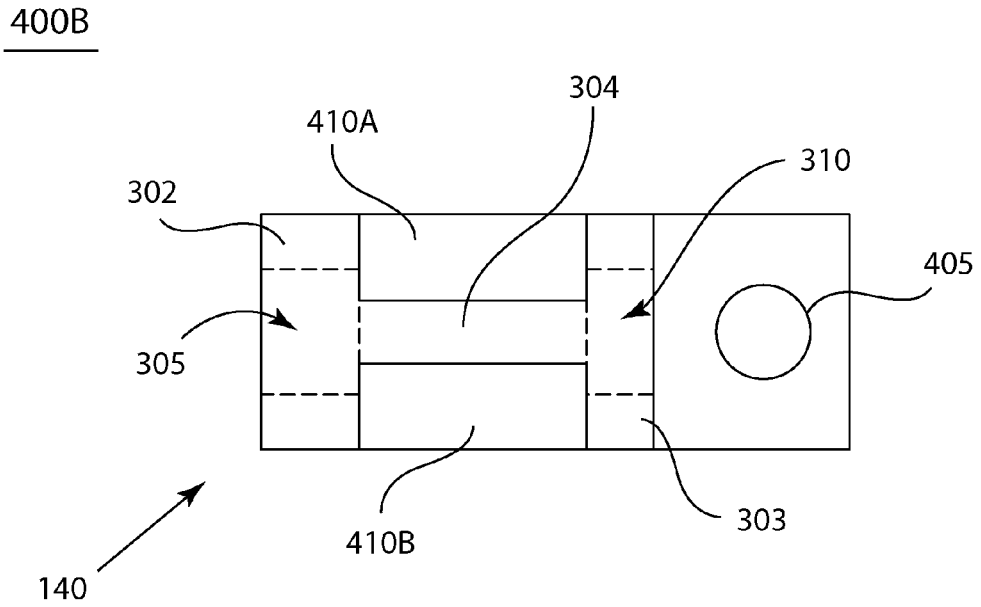

Referring now to FIGS. 4A and 4B, are a side view 400A and a top view 400B, respectively, of the main nut holder 140 for the present invention is shown, according to an exemplary embodiment of the invention. The side view 400A of the main nut holder 140 more clearly shows the mounting hole 405 (dashed lines) through the base plate 301 for inserting bolt 145 through so as to mount the main nut holder 140 to the stationary or fixed jaw 110 housing. It also shows the opening 410 in the main nut holder 140 where the vise main nut is inserted and held into position by the spindle 125 shaft 237. As can be seen, the opening 410 is bounded by the base plate, 301, the front wall 302, the back wall 303, and the top bar 304. One can also see a better view of the front wall through hole 305 (dotted lines) and the back wall 303 through hole 310 (dotted lines), through which the spindle shaft 237 may extend. The top view 400B of the main nut holder 140 more clearly shows the relative width of the top bar 304 to the entire width of the front wall 302 and back wall 303. It also improves an understanding of the location and relative size of the spindle shaft 237 through holes 305 and 310 (dotted lines) as well as the location of the main nut holder 140 mounting hole 405. Furthermore, the main nut holder 140 side view 400A and top view 400B helps to better appreciate the relative sizes for each of the portions of the main nut holder 140.

Figure 5A:
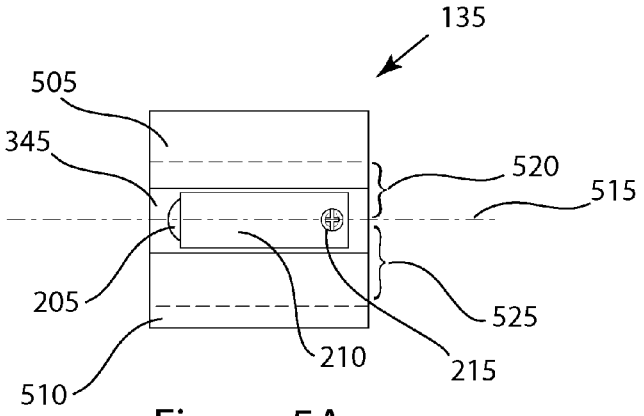
FIGS. 5A, 5B and 5C are a side view, a top view, and a plan view, respectively, of the vise main nut with the friction stud, tension spring, and spring attachment screw all assembled together, according to at least one exemplary embodiment of the invention.
Figure 5B:
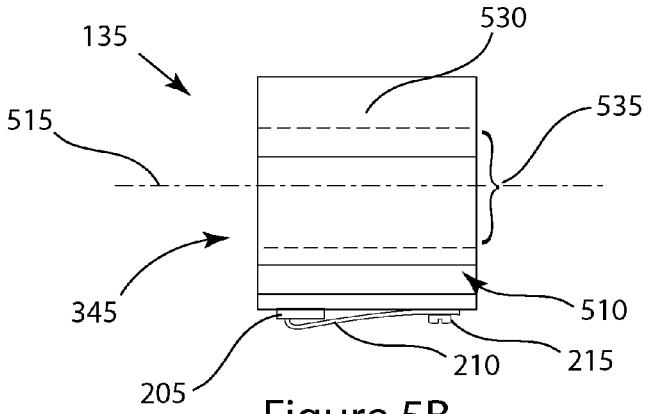
Figure 5C:
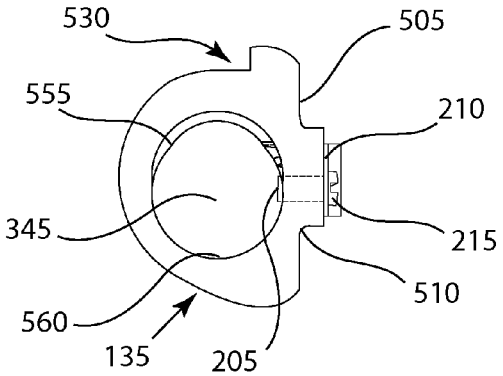

Referring now to FIGS. 5A, 5B and 5C, a side view 500A, a top view 500B, and a plan view 500C, respectively, of the vise main nut 135 with the friction stud, post or pin 205, tension spring or plate 210, and spring attachment screw 215 all assembled together are shown, according to at least one exemplary embodiment of the invention. FIG. 5A provides a side view 500A of one possible design for the vise main nut 135. In this case one side of the vise main nut 135 may have a plateau 345 and two adjacent areas that may have, for example, a slopped indent or concave surface on both sides 505 and 510. The friction stud, post or pin 205, tension spring or plate 210, and spring attachment screw 215 are all shown assembled together on the plateau 345 and along a center line 515 of the vise main nut 135 side view 500A. The oblong, oval or slot shaped through hole 320 (dotted lines) has one side 520 from the center line 515 that is shorter or smaller than the other side 525 from the center line 515, indicating that the through is not a perfect circle and is offset from the center line 515. FIG. 5B is a top view of the vise main nut 135 in the engaged position. In this view it can be seen that the through hole 345 in this orientation of the vise main nut 135 is symmetrical 535 about the center line 515. Further, the vise main nut 135 may have a ridge or cut away 530, although the vise main nut 135 may actually function well without the ridge or cut away 530 by relying on the height or width dimension of the vise main nut 135 to engage with a surface of the nut holder 140, e.g., top bar 304 or base 301 (see for example FIG. 3). This ridge or cut away 530 may help to ensure that the vise main nut 135 will not rotate more than desired in the engaged position by creating a straight flat wall or hook type ridge that will, for example, abut a side of the top bar 304 when the vise main nut 135 is rotated as far clockwise as it will go. In that position the then top surface of the vise main nut 135 will also urge against a lower surface of the top bar 304 and against a top surface of the spindle shaft 237 to ensure the threads of the vise main nut 135 are fully engaged with a portion of the threads on the spindle shaft 237. FIG. 5C is a plan view of the vise main nut 135 for one of its sides that may abut one of the inner surfaces of the vise main nut holder 140 front wall 302 or back wall 303, preferably the side abutting the inner face of the back wall 303. In this view, the ridge or cut away 530, slopped indent or concave surface on both sides 505 and 510, and possible eccentric shape may be seen more clearly. Further, a portion of the partial inner through hole 345 threads 555 can be seen along with the oblong or slotted shape as indicated by area 560 at the bottom of the through hole 345. Finally, the inside end of the friction stud, post or pin 205 can be seen extending into the through hole 345 to show that is will also help to urge the threads of the spindle shaft 237 into the partial threads 55 of the vise main nut 135.

Figure 6A:
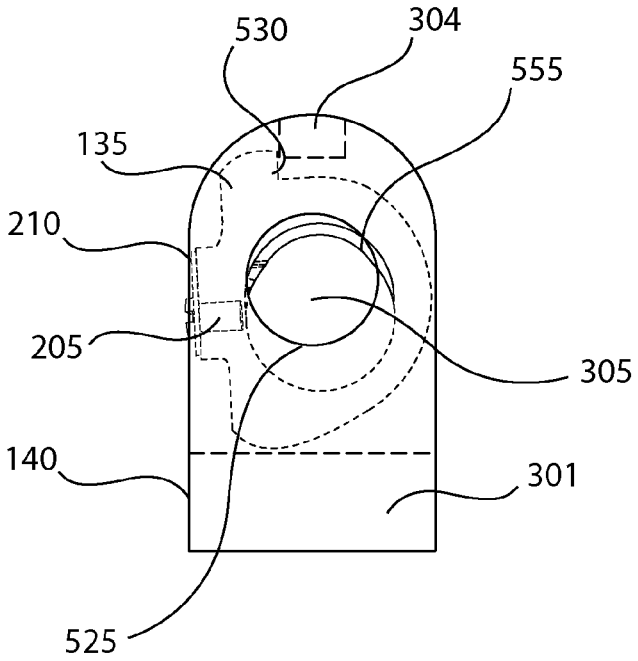
FIGS. 6A and 6B are side views of the main nut holder with the vise main nut inside the main nut holder (shown in dashed lines) oriented so that the main nut would be engaged with the vise spindle and so that the vise main nut would be disengaged with the vise spindle, respectively, according to at least one exemplary embodiment of the invention.
Figure 6B:
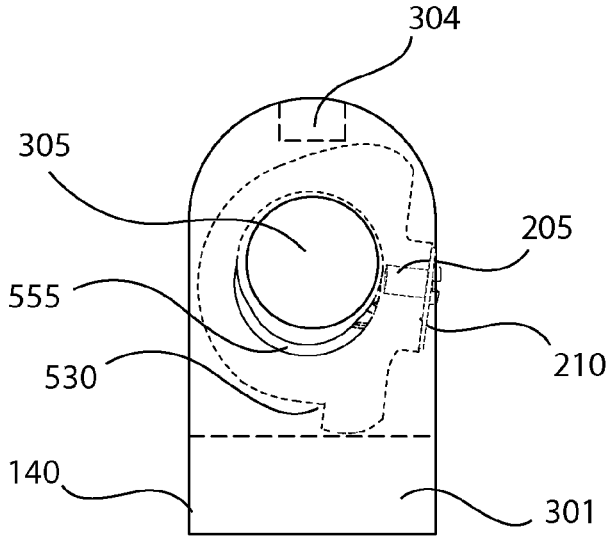

Referring now to FIGS. 6A and 6B, FIGS. 6A and 6B are side views 600A and 600B of the main nut holder 140 with the vise main nut 135 (shown in dashed lines) inside the main nut holder 140 oriented so that the main nut 135 would be engaged with the vise spindle shaft 237 and so that the vise main nut 135 would be disengaged with the vise spindle shaft 237 threads, respectively, when looking at the configuration 130 is viewed looking at it from the face of the vise main nut holder front wall 302 according to at least one exemplary embodiment of the invention. FIG. 6A illustrates how the vise main nut 135 orientation may be when the spindle shaft 237 screw threads are engaged so that the moveable jaw 115 may be moved toward the stationary or fixed jaw 110 slowly with clockwise movement of the spindle 125 and/or tommy bar 127. In this orientation, the quick release or quick action feature/function is disabled and the lip or ridge 530 on the vise main nut 135 is abutting the side wall of the top bar 304, with the threads 555 along the upper semi-circle rim of through hole 305 (and through hole 310) and the smooth side 525 well below the lower semi-circle rim of through hole 305 (and through hole 310).

FIG. 6B illustrates how the vise main nut 135 orientation may be when the spindle shaft 237 screw threads are not engaged (they are disengaged) so that the moveable jaw 115 may be moved freely and quickly toward or away from the stationary or fixed jaw 110 without the need to turn or spin the spindle 125 and/or tommy bar 127. In this orientation, the quick release or quick action feature/function is enabled and the lip or ridge 530 on the vise main nut 135 is turned toward the base plate and the opposite face of that end of the vise main nut 135 may be abutting the base plate upper face and/or the opposite end of the vise main nut 135 may be abutting the lower surface of the top bar 304, with the threads 555 now below the lower semi-circle rim of through hole 305 (and through hole 310) and the smooth side 525 coincident or above the upper semi-circle rim of through hole 305 (and through hole 310). As such, with no threads 555 on the vise main nut 135 interfacing the spindle shaft 237 threads, the spindle shaft 237 may move feely in and out of the vise main nut 135 and vise main nut holder 140 assembly 130. As discussed above, as long as the vise main nut 135 is allowed to rotate freely for example, for approximately 180 degrees, within the vise main nut holder 140 in a counter-clockwise and clockwise manner, the vise quick action or quick release may be easily disengaged or engaged, respectively, easily with the turning of the spindle 125 and its shaft 237. The friction pin 205 will take the rotation of the spindle shaft 237 and translate it to rotation of the vise main nut 135, as long as there is no vise main nut 135 stop, spindle, screw, bolt or push switch 260 placing force on and stopping the vise main nut 135 from turning or rotating about the axis of the spindle shaft 237. One skilled in the art would recognize that which way the spindle 125 and vise main nut 135 would need to rotate to have the threads engage or disengage depends on whether the threads on the spindle shaft 237 and vise main nut 135 are right hand threads (clockwise-engage; counter clockwise-disengage) or left hand threads (counter clockwise-engage; clockwise-disengage).

Figure 7A:
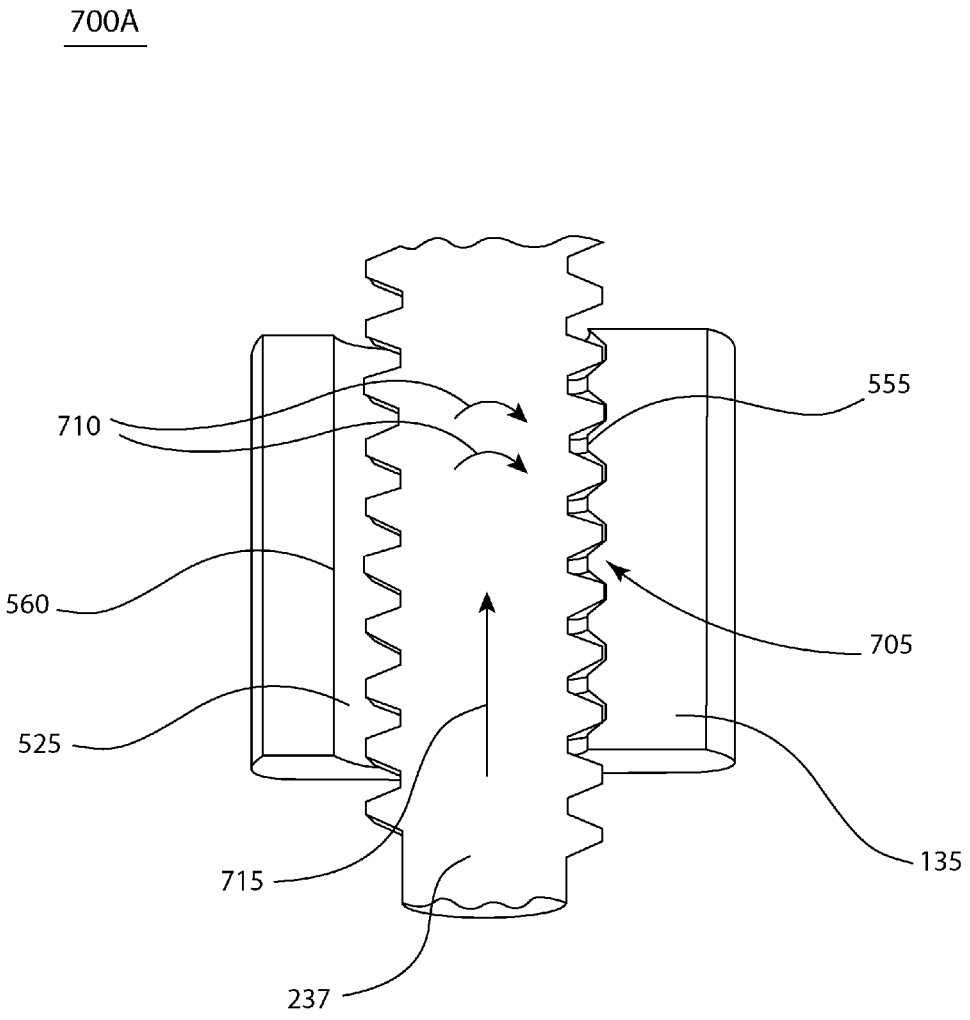
FIGS. 7A and 7B are cross sectional perspective views of the vise main nut and a portion of the vise spindle inside the vise main nut oriented so that the vise main nut would be engaged with the vise spindle and so that the vise main nut would be disengaged with the vise spindle, respectively, according to at least one exemplary embodiment of the invention.
Figure 7B:
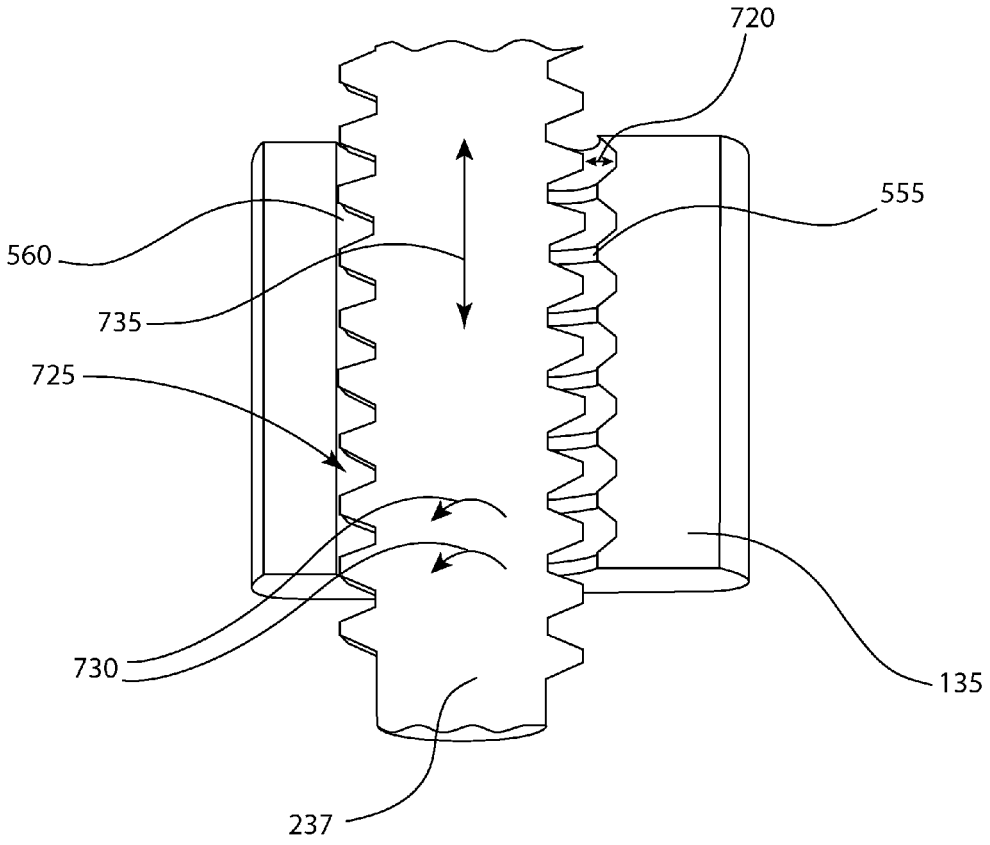

Referring now to FIGS. 7A and 7B, these figures illustrate cross sectional perspective views of the vise main nut 135 and a portion of the vise spindle shaft 237 inside the vise main nut 135 oriented so that the vise main nut 135 would be engaged with the vise spindle shaft 237 and so that the vise main nut 135 would be disengaged with the vise spindle shaft 237, respectively, according to an exemplary embodiment of the invention. As shown in the cross-sectional view of FIG. 7A, in various embodiments using right had threads, when the spindle shaft 237 is turned in the clockwise direction 710, the quick action feature/function will not be enabled, the thread of the spindle shaft 237 and the partial thread 555 inside one side of the vise main nut 135 are engaged 705, and the spindle shaft 237 will slowly move in the inward direction 715 (bottom to top in the drawing) moving the moveable jaw 115 toward the stationary or fixed jaw 110 slowly as the relatively narrow threads move in one direction. It is notable that in this state, there is space 525 between the smooth side 560 of the through hole 345 of the vise main nut 135 and the spindle shaft 237. As shown in the cross-sectional view of FIG. 7B, in various embodiments using right had threads, when the spindle shaft 237 is turned in the counter clockwise direction 730, the quick action feature/function will quickly become enabled, the thread of the spindle shaft 237 and the partial thread 555 inside one side of the vise main nut 135 are then disengaged, and the spindle shaft 237 will be able to quickly move in both directions 735 (bottom to top, and top to bottom, in the drawing) moving the moveable jaw 115 toward or away from the stationary or fixed jaw 110 quickly as the spindle shaft 237 easily slides 725 through and along the smooth non-threaded side 560 such that the threads on the spindle shaft will not catch 720 on any threads on the vise main nut 135. It is notable that in this state, there is space 720 between the threaded side 555 of the through hole 345 of the vise main nut 135 and the spindle shaft 237. As previously noted above and described in more detail below, in various embodiments of the present invention the vise may include a way to continuously disable the quick action feature/function, using for example a vise main nut lock, so that the slow in and out motion of a conventional vise can be obtain and the moveable jaw 115 may move slowly in and out relative to the stationary or fixed jaw based on the pitch of the screw thread on the vise main nut 135 and spindle shaft 237 as the spindle 125 is rotated.

Figure 8:
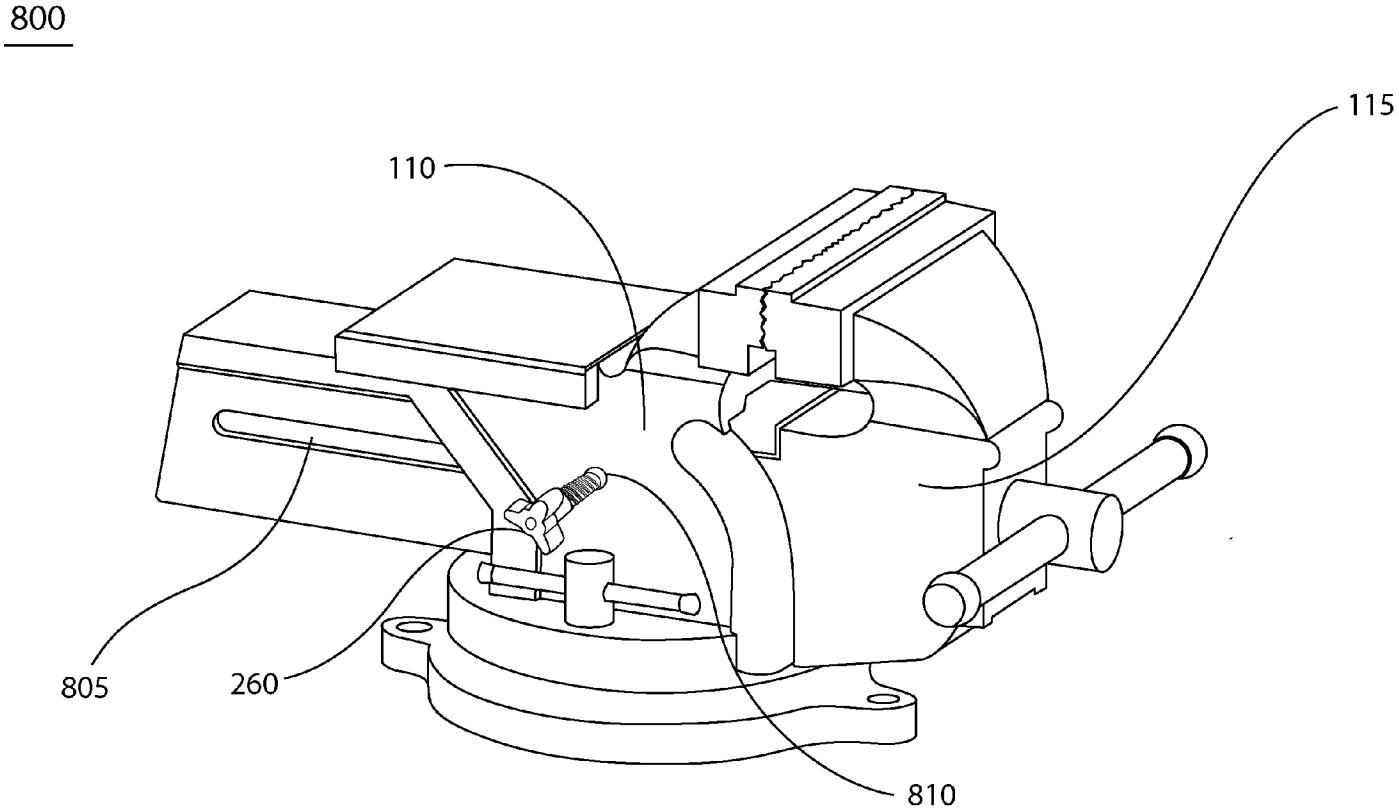
FIG. 8 is a perspective view of the present vise invention looking at it from the top left side to illustrate a vise main nut lock bolt and a slot in the moveable jaw elongated slide bar, according to at least one exemplary embodiment of the invention.

Referring now to FIG. 8, a perspective view 800 of the present vise invention is provided looking at a vise from the top left side to illustrate a vise main nut lock mechanism, for example a bolt 260, and a slot 805 in one side of the moveable jaw 115 elongated slide bar 117, according to at least one exemplary embodiment of the invention. The bolt 260 may be screwed into a threaded hole 810 formed in the side of the stationary of fixed jaw 110 housing at a location, for example, that is located adjacent to one side of the opening 410 in the vise main nut holder 140. In this way, when the vise main nut 135 is rotated to a position where the partial threads inside the vise main nut 135 are engaged or interdigitated with the threads on the spindle 125 shaft 237 and the inside end of the bolt 260 abuts one side of the outside surface of the vise main nut 135, the vise main nut is locked in the slow action state and operates like a conventional vise such that each turn or rotation of the spindle 125 in either direction moves the moveable jaw 115 only a small amount either toward or away from the stationary or fixed jaw 110, i.e., the quick action feature/function may thereby be disabled. Although the vise may include a vise main nut such as a bolt 260, one skilled in the art would appreciate that the locking mechanism 260 and the slot 805 may or may not be included, and the lock may be formed in a number of ways. For example, the locking mechanism may be accomplished using a small spindle, a bolt with a wing nut head, a push pin with lock, a screw, a depress switch, etc., as long as a distal end of the device can abut a side of the vise main nut and keep it from rotating about its axis of rotation, for example the spindle shaft 237 inside the stationary or fixed jaw 110 housing and moveable jaw 115 slide rail 117.

One purpose of the locking mechanism 260 is to provide a safety feature so that when preferred, an operator can disable the quick action feature/function of the invention. For example, a user may wish to loosen the grip of the vise jaws a small amount from each other and a work piece held therein, without being concerned that the quick action feature/function will be activated and the moveable jaw will loosen too quickly causing the work piece to drop out of the jaws unless the user holds the work piece. Likewise, a vise user may need to strike the work piece held in the vise with a hammer, so they may desire to keep the spindle and or the main vise screw rotation from inadvertently triggering the quick action feature/function and the jaws opening causing the work piece to move and drop out of the vise. In any case, the main vise nut locking mechanism 260 and slot may be added so that the vise is more versatile and safer for the user.

Figure 9:
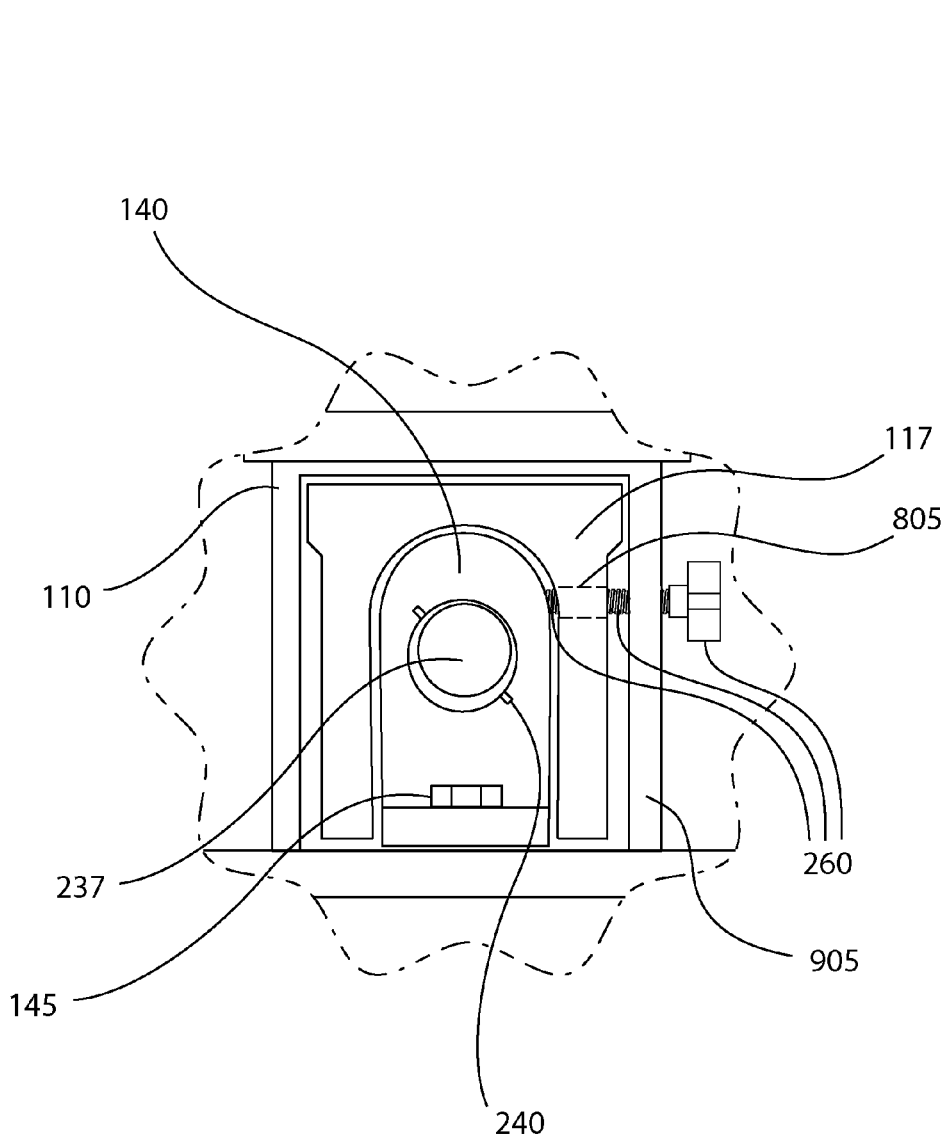
FIG. 9 is a partial back view of the present vise invention illustrating the vise main nut locking mechanism as seen when it is keeping the vise main nut from rotating and thereby disabling the quick action feature/function, according to at least one exemplary embodiment of the invention.

Referring now to FIG. 9, a partial back view of the present vise invention is shown illustrating the vise main nut locking mechanism as seen when it is keeping the vise main nut from rotating and thereby disabling the quick action feature/function, according to at least one exemplary embodiment of the invention. As can be more clearly seen from this view, the vise main nut locking mechanism 260 may be threaded and may extend through a side 905 of the stationary or fixed jaw 110 housing, through a slot 805 (dotted lines) in the moveable jaw 115 slide bar 117, and abut a side of the vise main nut 135 (not shown) via an opening in the side of the vise main nut holder 140. In this way, the vise main nut 135 may be stopped from rotating when the vise main nut lock 260 is turned in to abut a top side surface of the vise main nut 135, and allowed to rotate when the vise main lock 260 is turned out enough away from the vise main nut 135, for example, to the inside edge of the slot 805 in the moveable jaw 115 slide bar 117. Also shown in this vies is the bolt 145 is shown for securing the vise main nut holder 140 to the stationary or fixed jaw 110 housing, and the distal end of the spindle 125 shaft 237 is shown with a stop pin 240 inserted there through so that the spindle 125 shaft may not be accidentally removed from the vise main nut 135 and the vise main nut holder 140. The vise moveable jaw, stationary jaw, base plate, main nut, nut holder may be made from, for example, iron, steel, and/or plastic by casting, molding, or machining. The vise spindle, handle, locking screws may be made from, for example, steel or plastic by machining or molding.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. For example, the materials used to make a vise may include many metals or metal substitutes that can withstand the forces and stresses of a typical bench or mechanics vise of a particular size. Thus, the invention is intended to cover alternatives, modifications, and equivalents, which may be included within the spirit and scope of the invention as defined by the claims.

All publications, patent applications, and patents cited herein are hereby incorporated by reference in their entirety for all purposes.

What is claimed is:

1. A vise, comprising:

a stationary or fixed jaw having a hollow housing or an opening;

a moveable jaw having an elongated slide bar that fits inside the hollow housing of the fixed jaw and has a hollow center;

a vise main nut holder that fits inside the hollow center of the moveable jaw;

a vise main nut having a friction pin mounted therein and rotatably mounted inside the nut holder so that unless restricted it will rotate about an internal axis such that when rotated in a first direction the moveable jaw will move freely and quickly toward and away from the stationary or fixed jaw and when rotated in a second direction the moveable jaw is limited to move slowly toward the stationary or fixed jaw.

2. The vise of claim 1, further comprising:

a spindle having a threaded shaft that is inserted through the vise main nut holder and the vise main nut, wherein rotating the spindle in first direction rotates the vise main nut in the same direction causing threads on the vise main nut to engage the threads on the threaded shaft and move the moveable jaw toward the stationary or fixed jaw and rotating the spindle in a second direction opposite the first direction rotates the vise main nut in the opposite direction causing threads on the vise main nut to disengage the threads on the threaded shaft and move the moveable jaw away from the stationary or fixed jaw.

3. The vise of claim 2, further comprising:

a vise main nut locking mechanism that when activated by a user restricts the vise main nut from rotating and when inactivated by a use allows the vise main nut to rotate within the vise main nut holder.

4. The vise of claim 1, further comprising;

a vise main nut locking mechanism that when activated by a user restricts the vise main nut from rotating and when inactivated by a user allows the vise main nut to rotate within the vise main nut holder.

5. The vise of claim 4, wherein the vise main nut locking mechanism abuts a surface of the vise main nut to thereby restrict and stop the vise main nut from rotating.

6. The vise of claim 1, wherein the vise main nut holder includes a base plate, a front wall, a back wall, and a top bar, all interconnected so as to form an opening into which the vise main nut is inserted and the vise main nut is thereby bounded on four of six of its sides, and the vise main nut holder is fixedly attached to a floor of the stationary or fixed jaw housing.

7. The vise of claim 1, wherein the vise main nut is a single piece of material, has an eccentric outer surface shape, and has a through hole that is not perfectly round and is only partially threaded so that part of the through hole has a smooth surface and part of the through hole has a threaded surface.

8. A vise, comprising:

a stationary or fixed jaw having a housing or an opening;

a moveable jaw having an elongated slide bar that fits inside the housing of the fixed jaw;

a spindle having an elongated shaft and attached to the moveable jaw;

a single piece vise main nut having an eccentric external shape, a slotted shaped through hole that is partially threaded, and is rotatably mounted to at least a portion of the stationary or fixed jaw and inside at least a portion of the moveable jaw, wherein the spindle elongated shaft extends through the slotted shaped through hole and when the spindle is rotated in a first direction the moveable jaw can be slid freely and quickly toward and away from the stationary or fixed jaw and when the spindle is rotated in a second direction the moveable jaw is limited to move slowly toward the stationary or fixed jaw.

9. The vise of claim 8, further comprising:

a vise main nut locking mechanism attached to the housing that when activated by a user keeps the vise main nut from rotating and when inactivated by a user allows the vise main nut to rotating.

10. The vise of claim 9, wherein the vise main nut locking mechanism abuts at least a portion of the eccentric shaped surface of the vise main nut, to thereby stop the vise main nut from rotating.

11. The vise of claim 10, wherein the vise main nut locking mechanism is a bolt, a screw, a small spindle, a small push pin, or a push to toggle switch.

12. The vise of claim 8, further comprising:

a vise main nut holder into which the vise main nut is rotatably mounted and the spindle elongated shaft is extended through, wherein the vise main nut holder includes a base plate, a front wall, a back wall, and a top bar, all interconnected so as to form an opening into which the vise main nut is rotatably inserted.

13. The vise of claim 12, wherein the vise main nut holder's base plate, front wall, back wall, and top bar, and the spindle shaft, cause the vise main nut to thereby be bounded on four of six of its sides at all times while allowing for rotational movement of the vise main nut with spindle rotation, and the vise main nut holder is fixedly attached to a floor of the stationary or fixed jaw housing.

14. The vise of claim 13, wherein the size of the opening in the vise main nut holder is narrower than the longest outside dimension of the vise main nut, so as to thereby stop or limit the rotation of the vise main nut inside the vise main nut holder to approximately 180 degrees or less when at least one point on the outer surface of the vise main nut abuts at least one of the base plate or top bar of the vise main nut holder.

15. The vise of claim 13, wherein the size of at least one of the outside dimensions of the vise main nut relative to the distance between the spindle shaft and at least one of the vise main nut holder's base plate, front wall, back wall, and top bar, limits the rotation of the vise main nut to be approximately 180 degrees or less, and thereby enables and disables a quick action feature/function by disengaging and engaging threads on the spindle shaft and partial threads in a through hole of the vise main nut.

16. A quick action vise, comprising:

a quick action mechanism, consisting essentially of:

a vise main nut holder having a base plate, front wall, back wall, and top bar, and a vise main half nut coupled to the vise main nut holder and spindle shaft, the vise main half nut having an eccentric shaped outer surface and a slot shaped through hole having approximately one half of the inside lateral surface of the through hole with threads and the other approximately half without threads, a friction pin inserted through a hole in the eccentric shaped outer surface of the vise main nut, and a plate or spring abutting an outer end of the friction pin and attached to the eccentric shaped outer surface with a screw; and a vise main nut lock that locks and stops the vise main half nut from rotation when abutting an area on the vise main nut eccentric shaped outer surface and allows vise main nut rotation when not abutting an area on the vise main nut eccentric shaped outer surface.

17. The quick action vise of claim 16, further comprising:

a spindle with a threaded elongated spindle shaft that is inserted through the vise main nut holder and vise main half nut, wherein the vise main nut holder is integrally formed as a single molded structure and the vise main half nut is formed as a single piece that has a ridge formed on the one of the thicker portions of the eccentric shaped outer surface that interfaces with a portion of the vise main nut holder top bar to securely stop rotation of the vise main half nut when the spindle is turned in one direction intended to engage the threads of the elongate spindle shaft and half threads inside the vise main half nut.

18. The quick action vise of claim 16, wherein the vise main nut lock is a bolt, a screw, a small spindle, a small push pin, or a push to toggle switch.

19. The quick action vise of claim 16, further comprising:

a stationary or fixed jaw having a housing or a opening;

a moveable jaw having an elongated slide bar that fits inside the housing of the fixed jaw; and a spindle having an elongated shaft and attached to the moveable jaw.

20. The quick action vise of claim 16, wherein the slot shaped through hole with half threads of the vise main half nut is formed by drilling a first round hole, shaping threads in the first round hole, drilling a second hole offset slightly from the first round hole so as to remove half of the threads in the first round hole and result in a slot or elongate shape to the through hole having one smooth side and one threaded side.

* * * * *